United States Patent [19]

Betts

[11] 4,337,702

[45] Jul. 6, 1982

[54] ELECTROEXPLOSIVE AND PERCUSSION SAFE AND ARM DEVICE

[75] Inventor: Robert E. Betts, Huntsville, Ala.

[73] Assignee: The United States of America as represented by the Secretary of the Army, Washington, D.C.

[21] Appl. No.: 158,009

[22] Filed: Jun. 9, 1980

[51] Int. Cl.[3] ..... F42C 15/34

[52] U.S. Cl. ..... 102/254; 60/256; 102/202

[58] Field of Search ..... 102/380, 222, 221, 254, 102/255, 256, 229, 235, 272, 200, 202, 204; 60/256

[56] References Cited

U.S. PATENT DOCUMENTS

| | | | |
|---|---|---|---|
| 2,627,160 | 2/1953 | MacDonald | 102/202 X |
| 3,204,559 | 9/1965 | DeMatthew | 60/256 X |
| 3,646,889 | 3/1972 | Davis | 102/229 |
| 4,026,211 | 5/1977 | Ostling | 102/254 X |
| 4,046,076 | 9/1977 | Hampton | 102/380 X |
| 4,099,465 | 7/1978 | Haake | 102/380 X |
| 4,099,466 | 7/1978 | Redmond et al. | 102/255 X |

FOREIGN PATENT DOCUMENTS

| | | | |
|---|---|---|---|
| 1528313 | 6/1967 | France | 102/255 |

*Primary Examiner*—David H. Brown
*Attorney, Agent, or Firm*—Nathan Edelberg; Robert P. Gibson; James T. Deaton

[57] ABSTRACT

An electroexplosive device and percussion safe and arm device in which a piston actuated squib or a directional shaped charge is used to set off a pyrotechnic booster charge that is rotated relative to the squib to align the booster charge with the squib and thereby enable the squib to set the booster charge off. The booster charge is used to ignite an initiator main charge or an additional booster charge that then sets off an initiator main charge.

5 Claims, 8 Drawing Figures

ELECTROEXPLOSIVE AND PERCUSSION SAFE AND ARM DEVICE

DEDICATORY CLAUSE

The invention described herein may be manufactured, used, and licensed by or for the Government for governmental purposes without the payment to me of any royalties thereon.

BACKGROUND OF THE INVENTION

In the past, a safe and arm design of an electroexplosive device has included those in which in-line-out-of-line squib is used to achieve a safe and arm requirement. This type device functions by aligning the squib over a sealed port. The squib is then fired to rupture a port barrier and ignite a pyro in the ignition train. By rotating the port out-of-line and/or using a closed volume for the squib to fire into causes the device to be safed. There are problems associated with this design in that the barriers must be reliably ruptured from the squib output pressure but not be ruptured from squib pressure when in the safe position. The barrier is ruptured from the squib output pressure which is difficult to control in magnitude and in a local area. Also, in these designs in order for the squib pressure to be appropriately applied to the barrier and the pyro, there must be close tolerances relative to sealing between the squib and the structure which carries the port barrier and the pyro. Accordingly, it can be seen that a more reliable device utilizing an in-line-out-of-line device is needed which will give better control on the pressure or squib output.

Therefore, it is an object of this invention to provide a particular squib and a percussion cap in place of the previously used squib and port barrier to provide a device that is more reliable and safer than that previously used.

Another object of this invention is to provide a squib that is a piston actuated squib or a jet squib which has a shaped and directed high force portion which can act on a precussion cap or primer.

A further object of this invention is to provide a safe and arm device in which the squib has to be misaligned only a few degrees to prevent the safe and arm device from being operated.

Other objects and advantages of this invention will be obvious to those skilled in this art.

SUMMARY OF THE INVENTION

In accordance with this invention, a safe and arm device is provided for interrupting the ignition train to a rocket motor so that if in the event of an ignitor being accidently fired, propagation to the rocket motor is halted. This is accomplished by utilizing an ignition system that includes an initiator squib which directs its energy in a concentrated area onto a percussion cap which ignites a pyrotechnic booster charge which in turn ignites an initiator main charge for igniting a rocket motor. The initiator squib and the remainder of the elements of the system are rotatable relative to each other to misalign the initiator squib from the percussion cap, booster charge and initiator main charge to prevent accidental ignition of the rocket motor, and the elements are rotatable relative to each other and into alignment with each other when it is desired to ignite the rocket motor. In this invention, the initiator squib has a particular structure which causes its energy to be directed to a percussion cap which requires a predetermined force acting directly thereon to set off the booster charge. By utilizing the particular initiator squib with the percussion cap arrangement of the system, a more reliable and fail proof system to accidential ignition of the main rocket motor is attained.

DESCRIPTION OF THE PREFERRED EMBODIMENTS

Figure 1:
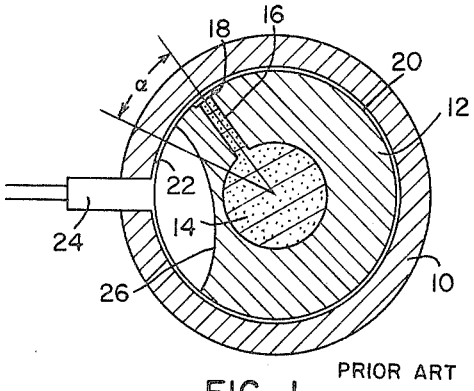
FIG. 1 is a schematic sectional view of a typical safe and arm device in a safe position.
Figure 2:
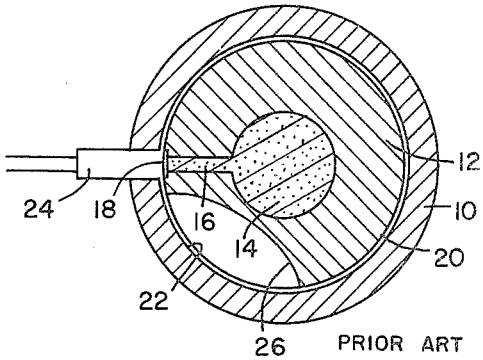
FIG. 2 is a schematic view in section of a safe and arm device in a position for ignition of a rocket motor.
Figure 3:
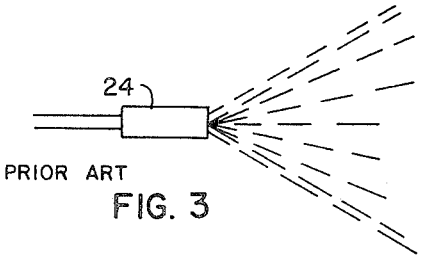
FIG. 3 is a schematic perspective view of an initiator squib of the type used in the safe and arm arrangement of FIGS. 1 and 2.

Referring now to the drawing, a known structure for safing a rocket motor against accidential ignition is illustrated in FIGS. 1 through 3 and includes a housing 10 with a core 12 which contains therein a pyrotechnic booster charge 14 that is mounted in core 12 in a conventional manner and has a side portion 16 which is sealed near an outer surface of core 12 with a rupture diaphragm or very thin burst disk 18. Burst disk 18 has a thickness of about 0.001 inches. The outer surface 20 of core 12 and the inner surface 22 of housing 10 have close fitting surfaces to substantially seal therebetween and when core 12 and housing 10 are aligned as illustrated in FIG. 2, the safe and arm device is ready for ignition of the rocket motor. A conventional booster charge 24 which produces a pressure pattern as illustrated in FIG. 3 is mounted on housing 10 as illustrated for applying the pressure produced upon ignition of booster charge 24 to cause rupture of burst disk 18 and in turn ignition of pyrotechnic booster charge 14,16. Core 12 is provided with a cut out chamber portion 26 which is aligned with squib 24 to the position illustrated in FIG. 1 to safe the device and upon accidential ignition of squib 24, the pressure produced therefrom will be vented into chamber 26 and thereby prevented from exerting sufficient pressure on burst disk 18 to cause it to be ruptured and setoff pyrotechnic booster charge 14,16. In this arrangement, core 12 can be rotated relative to housing 10 or housing 10 can be rotated relative to core 12 in order to align side charge 16 and diaphragm 18 with squib 24 for ignition of the pyrotechnic booster charge. Also, with this embodiment in order to insure that the device is in a safe condition core 12 and housing 10 must be rotated relative to each other by an anuglar amount $\alpha$ which is several degrees and specifically about 15° or so. Therefore, it can be seen that in this prior arrangement, proper operation thereof depends upon burst disk 18 strength and the pressure output of squib 24. Also, in devices of this arrangement, there is always some pressure leakage between surfaces 20 and 22 to burst disk 18. Therefore, core 12 and housing 10 must always be rotated a predetermined distance such as alpha relative to each other to insure that the device will not be prematurely set off. Also, with this prior device the pressure from squib 24 must be sealed relative to disk 18 to enable sufficient pressure to be built up to rupture burst disk 18 and set off booster charge 14,16.

Figure 4:
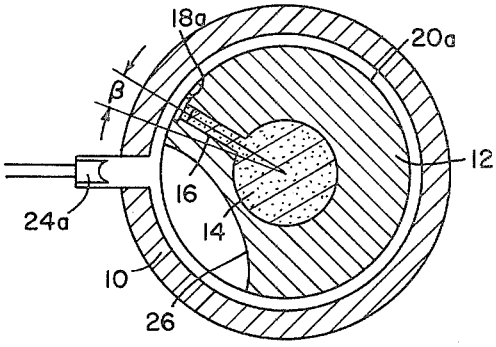
FIG. 4 is a schematic sectional view of a safe and arm device in accordance with this invention and illustrated in a safe position.
Figure 5:
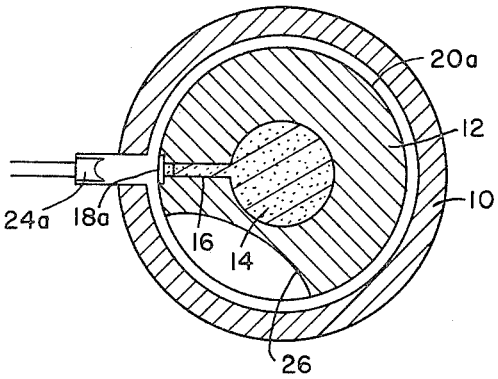
FIG. 5 is a schematic sectional view in accordance with this invention with the device positioned in the arming or a position for igniting the rocket motor.
Figure 6:
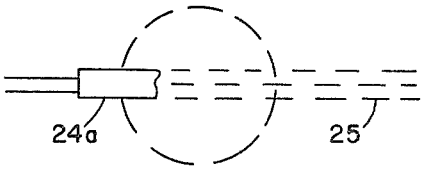
FIG. 6 is a plan view illustrating a shaped charge squib which directs its energy in a concentrated area and is used in the devices of FIGS. 4 and 5.

Referring now to FIGS. 4 and 5, an embodiment of this invention is disclosed which relates to a safe and arming device whereby improved safety, increased reliability, simplicity, and reduced cost is achieved. In this embodiment, the safe and arming device includes a housing 10 with a shaped charge squib 24*a* mounted thereon and having the shaped charge thereof designed to produce a force pattern in an actual direction as illustrated in FIG. 6 at 25. Housing 10 has a core 12 mounted internally thereof and core 10 and housing 12 are mounted for rotation of either relative to the other to align a percussion cap 18*a* at a peripheral surface 20*a* of core 12 to cause side charge 16 and booster charge 14 to be ignited when the force 25 applied from shape squib charge 24*a* is applied to percussion cap 18*a*. Percussion cap 18*a* is a conventional type percussion cap that is set off when predetermined force is applied to the face thereof. Core 12 is also provided with cut out chamber portion 26 to relieve any pressure produced by squib 24*a* when squib 24*a* is accidentially set off and by this means, the pressure is relieved. Core 12 is smaller in diameter than the inside diameter of housing 10 since a seal is not required. That is, by using a shaped charge squib and the percussion cap, the close tolerance between the core and the housing is not required since the percussion cap does not respond to pressure but rather to force acting thereon. This feature enables the device to be produced more economically.

In operation, when it is desired to ignite a rocket motor, either core 12 or housing 10 is rotated to align squib 24*a* with percussion cap 18*a* and squib 24*a* is set off to produce a force pattern as illustrated at 25 to cause percussion cap 28*a* to be set off and thereby ignite charge 16 and in turn booster charge 14 which sets off another charge or the rocket motor charge. In this embodiment, the squib shape charge and the percussion cap have to be aligned, but no sealing means is needed and further the percussion cap can be used with force much more easily and accurately than the burst disk of the prior arrangement disclosed in FIGS. 1 through 3. Also, in this embodiment of FIGS. 4 through 6, the percussion cap 18*a* only needs to be misaligned approximately 10 or 11 degrees such as angle $\beta$ as illustrated in order to safe the device and prevent shaped squib charge 24*a* from being effective in setting off percussion cap 18*a*.

Figure 7:
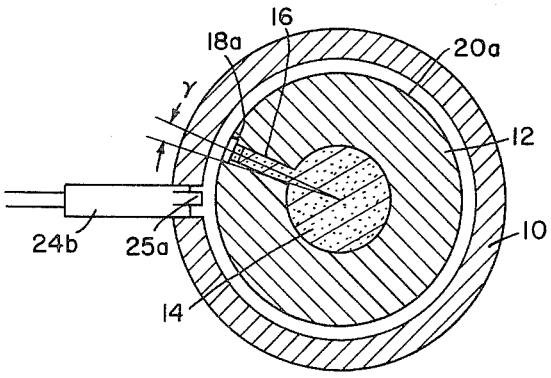
FIG. 7 is a schematic sectional view of another embodiment of a safe and arming device in accordance with this invention and illustrated in the safe position.
Figure 8:
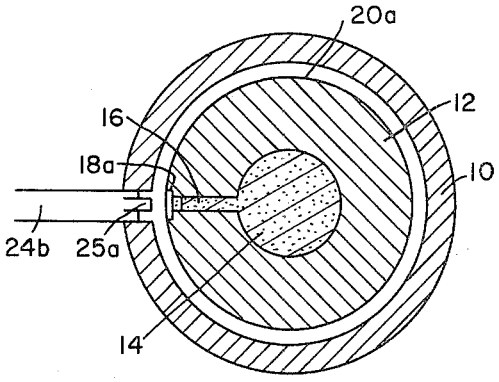
FIG. 8 is a schematic sectional view of the safe and arming device of FIG. 7 illustrated in the arming or igniting position for igniting a rocket motor.

Referring now to FIGS. 7 and 8, another embodiment of this invention is disclosed that includes housing 10 with core 12 mounted relative thereto so that higher housing 10 or core 12 can be rotated relative to the other member to align percussion cap 18*a* mounted at the periphery of core 12 with a piston type squib 24*b* which has a piston 25*a* for striking percussion cap 18*a* and setting off side charge 16 and booster charge 14 to cause the rocket motor to be ignited. Also, in this embodiment close tolerances between the inner surface of housing 10 and the outer surface 20*a* of core 12 is not required since a pressure type seal is not involved in this embodiment. That is, when it is desired to arm the device, members 10 and 12 are rotated relative to each other to align piston 25*a* with percussion cap 18*a*. When squib 24*b* is ignited, pressure is generated to cause piston 25*a* to be moved into contact with the face of percussion cap 18*a* and cause the percussion cap to be set off. Piston 25*a* can be spaced from about 0.25 inches to about 0.100 inches from the face of percussion cap 18*a*, but some space is needed between the end of piston 25*a* and the face of percussion cap 18*a*. Also, in this embodiment only a very small angle such as that illustrated as $\gamma$ is required in order to safe this device. That is, since piston 25*a* must strike the face of percussion cap 18*a* in order to set off charges 16 and 14, misalignment of piston 25*a* from the face of percussion cap 18*a* safes the device.

As can be seen, this invention provides a safe and arming device which has improved safety, increased reliability, simplicity of fabrication and a structure which results in reduced cost of the device. As can be appreciated, this invention incorporates a conventional type percussion cap for the burst disk 18 of the embodiment of FIGS. 1 through 3 and replaces the conventional pressure squib with a pressure profile as illustrated in FIG. 3 by either a shaped type squib charge with a force profile as illustrated in FIG. 6 or a piston actuated squib as used in FIGS. 7 and 8 for setting off the percussion cap and thereby the side charge and booster charge means. Improved safety in this arrangement as provided by applicant comes from the fact that the end thickness of percussion cap 18*a* requires a relative large amount of highly directed force to cause side charge 16, and booster charge means 14 to be set off. Leakage pressure from the directional squib is not sufficient to cause activation of percussion cap 18*a*. The piston squib arrangement has no leakage pressure and therefore activation is only caused by alignment of the piston squib with the percussion cap. With either of the arrangements of FIGS. 4 through 8, there is a loose arrangement of the housing to the core due to the type squib charge being used and due to the use of the percussion cap. Therefore, it can be clearly seen that a much needed and desired arrangement for safing a rocket motor is provided.

I claim:

1. In a safe and arming device having an outer housing with an inner core structure mounted for movement of the outer housing and the core structure relative to each other and with a pressure squib mounted on the outer housing for exerting pressure on a burst disk that is mounted on said core structure and with charge means mounted in the core structure for being ignited and set off by the pressure squib when sufficient pressure from the pressure squib is applied to the burst disk, the improvement comprising: said burst disk being replaced by a percussion cap and said pressure squib being replaced by a squib charge that applies force linearly toward a specific area to apply force to the face of said percussion cap to cause said percussion cap to be set off and thereby said charge means.

2. In a safe and arming device as set forth in claim 1, wherein said squib charge has a shaped charge therein that directs its energy in a generally linear force pattern.

3. In a safe and arming device as set forth in claim 1, wherein said squib charge is a piston actuated squib for applying force from said piston to the face of said percussion cap to cause said charge means to be set off.

4. In a safe and arming device as set forth in claim 3, wherein said piston of said squib is spaced about 0.100 inches to about 0.250 inches from the face of said percussion cap when said percussion cap and said squib piston are aligned.

5. In a safe and arming device as set forth in claims 2 or 4, wherein said core and said outer housing have a loose fit relative to each other.

* * * * *